United States Patent [19]

Fehrenbach et al.

[11] Patent Number: 4,741,315

[45] Date of Patent: May 3, 1988

[54] PRESSURE REGULATING APPARATUS

[75] Inventors: Siegfried Fehrenbach, Markgröningen; Kurt Herbst, Burgstetten, both of Fed. Rep. of Germany

[73] Assignee: Robert Bosch GmbH, Stuttgart, Fed. Rep. of Germany

[21] Appl. No.: 931,811

[22] Filed: Nov. 18, 1986

[30] Foreign Application Priority Data

Mar. 8, 1986 [DE] Fed. Rep. of Germany ..... 3607812

[51] Int. Cl.[4] ..... F02M 39/00

[52] U.S. Cl. ..... 123/463; 123/467

[58] Field of Search ..... 123/463, 456, 467, 468, 123/514, 447, 457

[56] References Cited

U.S. PATENT DOCUMENTS

| | | | |
|---|---|---|---|
| 4,205,637 | 6/1980 | Ito | 123/447 |
| 4,284,039 | 8/1981 | Bellicardi | 123/463 |
| 4,608,957 | 9/1986 | Kemmner | 123/447 |
| 4,615,320 | 10/1986 | Fehrenbach | 123/467 |
| 4,633,901 | 1/1987 | Brandt | 123/463 |
| 4,646,700 | 3/1987 | Tuckey | 92/97 |

FOREIGN PATENT DOCUMENTS

| | | | |
|---|---|---|---|
| 0071726 | 6/1978 | Japan | 123/463 |
| 0240866 | 11/1985 | Japan | 123/447 |

*Primary Examiner*—Carl Stuart Miller

*Attorney, Agent, or Firm*—Edwin E. Greigg

[57] ABSTRACT

A pressure regulating apparatus which serves to regulate fuel pressure in a fuel injection system for internal combustion engines. The pressure regulating apparatus includes a pressure regulating valve, which has a valve diaphragm fastened in a valve housing and defining a fuel chamber, which communicates via an inlet conduit with a fuel distributor line. Protruding into the fuel chamber is a valve seat carrier body having a valve seat body, on which a valve seat is embodied, from which an outlet conduit leads to an outlet fitting. The pressure regulating valve is inserted into a holder bushing communicating with the fuel distributor line and is sealed off therefrom by a sealing ring disposed on the regulating valve. The axial fixation of the pressure regulating valve in the holder bushing is effected via a screw connection with a retaining body.

5 Claims, 1 Drawing Sheet

PRESSURE REGULATING APPARATUS

BACKGROUND OF THE INVENTION

The invention is based on a pressure regulating apparatus. A pressure regulating apparatus is already known in which a pressure regulating valve is mounted on a fuel distributor line and threaded onto the distributor line. In the prior art apparatus, because of the necessary seals, the structural size cannot be less than a certain minimum, and the screw connection limits the ways the pressure regulating valve can be installed in various rotational directions, given the many engine types in which it may be used.

OBJECT AND SUMMARY OF THE INVENTION

The pressure regulating apparatus according to the invention has the advantage over the prior art that sealing of the pressure regulating valve is simplified considerably and so it is possible to reduce the structural size and attain a desired rotation of the pressure regulator, so as to adapt the installed position of the pressure regulating valve to various engine types.

It is particularly advantageous to provide an elastic sealing ring as the seal, disposing the sealing ring in a sealing groove of the valve housing.

It is also advantageous to insert the valve seat body sealingly into a valve seat carrier body joined to the valve housing, enabling the selection of different materials for the valve seat carrier body and the valve seat body itself to adapt the materials to given requirements. For the valve seat body, for example, a material which assures particularly low wear and high corrosion resistance, such as ceramic, can be selected.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
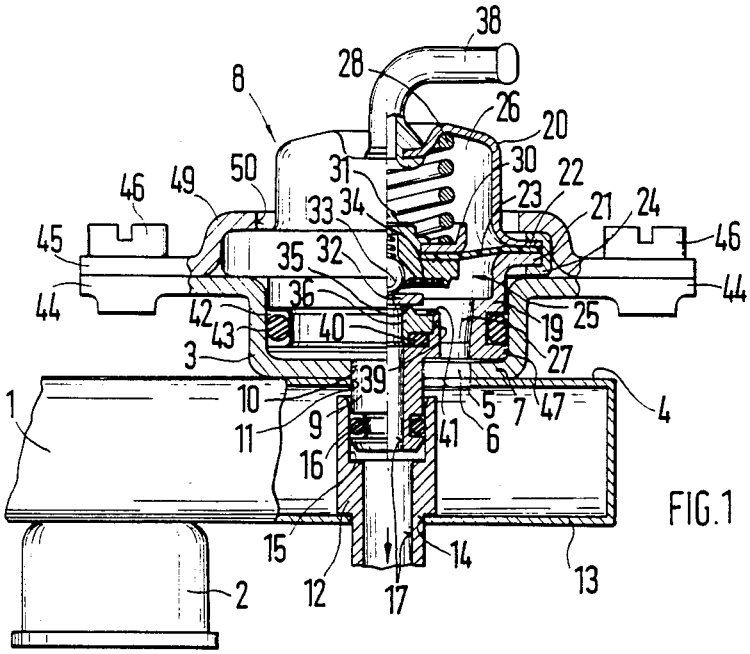
FIG. 1 shows a first exemplary embodiment of a pressure regulating apparatus according to the invention.
Figure 2:
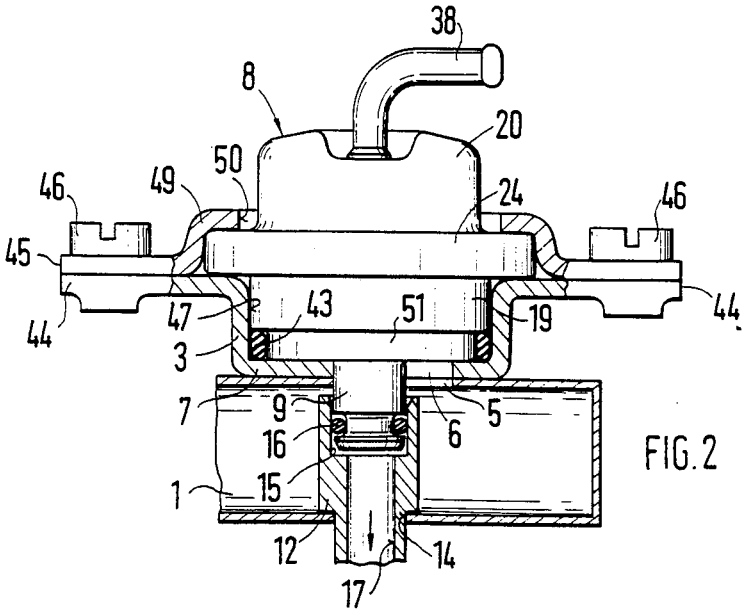
FIG. 2 shows a second exemplary embodiment of a pressure regulating apparatus according to the invention.

In FIGS. 1 and 2, a rigid fuel distributor line 1, made for instance from metal, of a fuel injection system for internal combustion engines is shown, having a plurality of plug connections 2 (only one being shown) into which fuel injection valves are inserted with one of their ends. Joined to the wall of the fuel distributor line 1, for instance by soldering or welding, is a cup-shaped holder bushing 3, which may also be integrally molded onto the fuel distributor line and/or may protrude at least partway into the fuel distributor line 1. In the wall 4 of the fuel distributor line 1 oriented toward the holder bushing 3, at least one inlet opening 5 is provided, which is in alignment with a connecting opening 6 in the bottom 7 of the holder bushing 3. The inlet opening 5 and connecting opening 6 may also be annular. A pressure regulating valve 8 is inserted into a guide bore 47 of the holder bushing 3. The pressure regulating valve 8 includes a valve seat carrier body 9, which protrudes sealingly into an outlet fitting 12 through a first insertion opening 10 in the holder bushing 3 and a second insertion opening 11 in the wall 4 of the fuel distributor line 1. The outlet fitting 12 protrudes into the fuel distributor line 1 and penetrates the wall 13 of the fuel distributor line 1 remote from the pressure regulating valve 8 in an opening 14 in which it is secured in a sealed manner, for instance by soldering. Instead of being embodied by the separate insertion openings 10, 11, the inlet opening 5 and the connecting opening 6 may also be embodied large enough that the valve seat carrier body 9 can be passed through the inlet opening 5 and connection opening 6 while a sufficiently large flow cross section about its circumference is maintained. With its end protruding from the pressure regulating valve 8, the valve seat body 9 protrudes into a receiving bore 15 of the outlet fitting 12 and is provided on its circumference with an elastic sealing ring 16 for sealing the valve seat body 9 with respect to the receiving bore 15. The outlet fitting 12 is penetrated in the axial direction by an outlet conduit 17, which leads in a manner not shown to a fuel tank or to the intake side of a fuel supply pump. The fuel distributor line 1 communicates with a fuel supply line that is connected to the feed outlet of the fuel feed pump.

The valve housing of the pressure regulating valve 8 is embodied by a bottom part 19 and a cap 20. The bottom part 19 is inserted into the holder bushing 3 and the valve seat carrier body 9 is either a separate part joined to the bottom part 19 or else is made as a part of the bottom part 19. The bottom part 19 has a shoulder 21 and the cap 20 has a shoulder 22, the two shoulders facing one another. A resilient valve diaphragm 23 is fastened between the shoulders 21 and 22 by means of a crimp or flange, not shown, or a separate crimped U-shaped ring 24 and divides a fuel chamber 25 in the bottom part 19 from a spring chamber 26 in the cap. The bottom part 19 is penetrated in the axial direction by at least one inflow opening 27 in alignment with the connecting opening 6, so that the inlet opening 5, connecting opening 6 and inflow opening 27 form an inlet conduit by way of which fuel can flow from the fuel distributor line 1 into the fuel chamber 25. A compression spring 28 is disposed in the spring chamber 26 and is supported on one end on the cap 20 and on the other end on a spring plate 30, which is secured to the valve diaphragm 23 by means of a connection 31 that extends in a sealed manner through the valve diaphragm 23 and grips it. The connection 31 includes a valve plate 32 that protrudes into the fuel chamber 25 and is movably supported in the rivet connection 31 by means of a ball 33 to which the valve plate is connected and a retaining clamp 34. The valve plate 32 is urged by the compression spring 28 toward a valve seat 35, which is embodied on a valve seat body 36 and at which the outlet conduit 17 originates. If the fuel pressure in the fuel distributor line, and hence in the fuel chamber 25 as well, rises above a value predetermined by the force of the compression spring 28, then the valve plate 32 is lifted from the valve seat 35 by the diaphragm, and fuel can flow from the fuel chamber 25 out via the outlet conduit 17.

Secured to the cap 20 is an air connection fitting 38, by way of which the spring chamber 26 can be made to communicate with the air intake tube of the engine downstream of a throttle valve, by means of a hose connection, not shown.

The valve seat carrier body 9 has a retaining bore 39 on its end oriented toward the fuel chamber 25; the valve seat body 36 is inserted into this bore 39 and held tightly in it by a crimped portion 41, with the interposition of an elastic sealing ring 40. Thus even when the pressure regulating valve is closed, or in other words the valve plate 32 is resting on the valve seat 35, leaking fuel cannot get into the outlet conduit 17 from the fuel chamber 25 via the retaining bore 39.

On its circumference, the bottom part in FIG. 1 has a sealing groove 42 which is open only in the radial direction and in which a seal is disposed that effects sealing in the radial direction and is embodied as an elastic sealing ring 43. Leading away from the bottom 7 of the bottom part in the axial direction, the holder bushing 3 surrounds the bottom part 19 of the pressure regulating valve 8 completely for a distance at least sufficient to assure reliable sealing by the sealing ring 43 between the bottom part 19 and the holder bushing 3.

For axial fixation of the pressure regulating valve 8 in the holder bushing 3, the holder bushing 3 may be provided on its end remote from the fuel distributor line 1 with at least two flanges 44 extending approximately parallel to the fuel distributor line and extending away from the pressure regulating valve. At least one retaining body 45, which is joined to the flanges 44 by means of screws 46, rests on the flanges 44 remote from the fuel distributor line 1. The pressure regulating valve 8 has a larger diameter, in the radial direction in the vicinity of the crimped ring 24, than the guide bore 47 of the holder bushing 3 into which the pressure regulating valve 8 is inserted, so that the crimped ring 24 rests on the flanges 44. Remote from the flanges 44, the retaining body 45 has a shoulder 49, which engages the crimped ring 24 opposite the flanges 44 and by means of the screw connection 46 fixes the pressure regulating valve 8 on the flanges 44 in the axial direction. The shoulder 49 may be annular and may be provided with an insertion opening 50, through which the cap 20 of the pressure regulating valve protrudes.

The exemplary embodiment of FIG. 2 differs from that of FIG. 1 only in that the sealing groove 51 for the elastic sealing ring 43 is disposed on the end of the pressure regulating valve 8 oriented toward the bottom 7 of the holder bushing 3 and is open in both the radial direction and the axial direction, facing the bottom 7, so that the sealing ring 43 placed in the sealing groove 51 is axially tensed and effects sealing as a result of the clamping of the pressure regulating valve 8 by the retaining body 45.

The pressure regulating apparatuses according to FIGS. 1 and 2 have the advantage that because only one sealing ring 43 is required on the circumference of the pressure regulating valve, they can be very small in structure, and as a result, the pressure regulating valve 8 can be rotated and fixed arbitrarily in the holder bushing 3, so as to be adapted to various types of engines.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A pressure regulating apparatus positioned on and connected to a rigid fuel distributor line for supplying fuel to fuel injection valves of a fuel injection system for internal combustion engines, said pressure regulating apparatus comprising a holder bushing including an upwardly extending wall and positioned on and secured to one side of said rigid fuel distributor line, a pressure regulating valve, said pressure regulating valve including a valve housing, said valve housing including a bottom part placed in a guide bore in said holder bushing and a cap, said pressure regulating valve having a resilient wall secured between said bottom part of said housing and said cap that divides a spring chamber from a fuel chamber in said valve housing, a valve carried by said resilient wall, an outlet fitting in said fuel distribution line secured to a bottom wall of said distributor line, a valve seat body which protrudes from said valve housing into said outlet fitting in said fuel distribution line, a valve seat on said valve seat body which cooperates with said valve, at least one inlet conduit in said bottom part of said holder bushing which communicates between said fuel chamber and said fuel distributor line, an outlet conduit which leads from said valve seat to a fuel return line via said valve seat body and said outlet fitting, said holder bushing (3) completely surrounds a portion of said valve housing bottom part (19) of said pressure regulating valve (8) and encompasses said at least one inlet conduit in an axial direction in an area leading away from said fuel distributor line (1), and an elastic seal (43) is disposed between said valve housing part (19) and said holder bushing (3).

2. A pressure regulating apparatus as defined by claim 1, in which said sealing ring (43) is disposed in a sealing groove (42, 51) of the valve housing bottom part (19) and serves as an elastic seal.

3. A pressure regulating apparatus as defined by claim 2, in which said sealing groove (51) is open in the radial direction and toward a bottom (7) of the holder bushing (3), and said elastic sealing ring (43) can be axially tensed in said sealing groove (51) between said valve housing bottom part (19) and said holder bushing (3).

4. A pressure regulating apparatus as defined by claim 1, in which said valve housing bottom part (19) is retained in the holder bushing (3) by means of a retaining body having a screw connection (44, 45, 46).

5. A pressure regulating apparatus as defined by claim 1, in which said valve seat body (36) is sealingly inserted into a valve seat carrier body (9) connected to the valve housing bottom part (19).

* * * * *